US005709586A

United States Patent [19]

Maier et al.

[11] Patent Number: 5,709,586

[45] Date of Patent: Jan. 20, 1998

[54] HONED MANDREL

[75] Inventors: Gary J. Maier, Webster; William G. Herbert, Williamson, both of N.Y.

[73] Assignee: Xerox Corporation, Stamford, Conn.

[21] Appl. No.: 436,755

[22] Filed: May 8, 1995

[51] Int. Cl.[6] ..... B24B 1/00; B24B 7/19; B24B 7/30

[52] U.S. Cl. ..... 451/28; 451/39

[58] Field of Search ..... 451/28, 75, 54, 451/55, 39; 427/144, 307, 327, 405, 436, 135, 383.7, 287, 271

[56] References Cited

U.S. PATENT DOCUMENTS

| | | | |
|---|---|---|---|
| 3,397,125 | 8/1968 | Tapley | 204/3 |
| 3,558,290 | 1/1971 | Baier et al. | 29/195 |
| 3,577,330 | 5/1971 | Knapp | 204/112 |
| 3,668,081 | 6/1972 | Borner | 204/12 |
| 3,844,906 | 10/1974 | Bailey et al. | 204/9 |
| 3,847,649 | 11/1974 | Sova | 117/47 A |
| 3,865,699 | 2/1975 | Luch | 204/20 |
| 4,040,937 | 8/1977 | Iijima et al. | 204/281 |
| 4,158,612 | 6/1979 | Luch et al. | 204/12 |
| 4,409,070 | 10/1983 | Stevens | 204/4 |
| 4,501,646 | 2/1985 | Herbert | 204/4 |
| 4,845,310 | 7/1989 | Postupack | 174/35 R |
| 4,902,386 | 2/1990 | Herbert et al. | 204/9 |
| 4,937,030 | 6/1990 | Nishiyama et al. | 264/162 |
| 5,044,123 | 9/1991 | Hoffman | 51/73 R |
| 5,131,893 | 7/1992 | Herbert | 474/260 |
| 5,196,106 | 3/1993 | DuPree et al. | 205/67 |

FOREIGN PATENT DOCUMENTS

| | | |
|---|---|---|
| 51-142430 | 12/1976 | Japan . |
| 2225688 | 9/1990 | Japan . |

*Primary Examiner*—James G. Smith
*Assistant Examiner*—Derris H. Banks
*Attorney, Agent, or Firm*—T. L. Fair

[57] ABSTRACT

An electroforming process and apparatus for forming an electroform with a roughened surface. An electroform with a roughened surface is formed by plating a reusable mandrel with a roughened surface. The reusable mandrel surface is roughened using a sandblasting device. The surface of the reusable mandrel is coated with a dual catalyzed non-self regulating crack free chromium deposit and a surface preparation to maintain the roughened surface. An alternate embodiment of the reusable mandrel utilizes a stainless steel mandrel without the chromium deposit on the surface. The roughened electroform surface enables toner distribution and sealing of the toner distribution module.

7 Claims, 1 Drawing Sheet

HONED MANDREL

CROSS REFERENCE

Cross reference is made to and priority is claimed from U.S. patent application Ser. No. 08/436,920, entitled "Stepped Honed Core Mandrel", in the name of William G. Herbert et al., assigned to the same assignee as the present application and filed concurrently herewith.

BACKGROUND OF THE INVENTION

This invention relates generally to an electroforming process, and more particularly, concerns a process for enabling electroforming of rough surfaces on small diameter thin-walled sleeves using a permanent mandrel.

The fabrication of hollow metal articles by an electroforming process is well known. For example, hollow metal articles are fabricated by electro-depositing a metal onto an elongated mandrel which is suspended in an electrolytic bath. The resulting seamless electroformed tubes are thereafter removed from the mandrel by sliding the tube off one end of the mandrel. Different techniques have been developed for forming and removing tubes from electroforming mandrels depending upon the cross-sectional area of the electroformed tube. Examples of these techniques are described in U.S. Pat. No. 3,844,906 to R. E. Bailey et al. and U.S. Past. No. 4,501,646 to W. G. Herbert.

Electroforms are manufactured using a bath to create surface roughness of the electroforms. This bath induced surface roughness varies considerably depending upon the thickness of the electroform. Electroforms with roughened surfaces are also made by sand blasting the surface of disposable mandrels. An electroform is then plated onto the surface of the mandrel. The plated electroform is separated from the mandrel by dissolving the mandrel. Thus, a new mandrel is required for each electroform made which is not economical.

The following disclosures may be relevant to various aspects of the present invention and may be briefly summarized as follows:

U.S. Pat. No. 5,196,106 to DuPree et al. discloses a process for forming an infrared absorbing cold shield which comprises anodizing an aluminum mandrel for the cold shield to provide a porous layer of aluminum oxide over the surface of the mandrel. The anodized mandrel is then immersed in an electroforming solution and metal is electrolytically deposited into and over the aluminum oxide layer. The aluminum mandrel is then selectively dissolved, leaving a metal body of the electroformed metal with a layer of infrared absorbing aluminum oxide mechanically anchored to the interior surface of the metal body.

U.S. Pat. No. 5,131,893 to Herbert discloses an endless metal belt assembly made with opposing adjacent belt surfaces that may contain a roughened surface containing protuberances, indentations, and/or pits and are configured such that a lubricant can be held and circulated between the adjacent surfaces. The roughened surface may be formed by an electroforming process in which one or more components of the electroforming baths and the operating parameters of the electroforming baths are adjusted to create the protuberances, indentations and/or pits. A belt assembly formed in this manner is useful as a driving member for continuously variable transmission.

U.S. Pat. No. 5,044,123 to Hoffman discloses an apparatus for producing concave or convex optically magnified facets about a gem, each facet being a curved surface that is a section of a cylinder. It utilizes a mandrel having an exterior and/or interior cylindrical abrasive surface. The mandrel is angularly movable about its central axis. The method of producing the optically magnified facet requires successive indexing of the gem and bringing it into contact with an angularly moving cylindrical abrasive surface.

U.S. Pat. No. 4,937,030 to Nishiyama et al. discloses a method of forming a slush mold and a synthetic resin skin utilizing the slush mold. The method includes the steps of roughing a foamed synthetic resin surface to define a prototype having a plurality of irregularly spaced and irregularly sized recesses, forming a metal mold to have a molding surface accurately, complimentary to the prototype surface and molding a skin of synthetic resin against the molding surface of the metal mold.

SUMMARY OF THE INVENTION

Briefly stated, and in accordance with one aspect of the present invention, there is provided a method for fabricating an electroform having a roughened surface. The fabrication method comprises roughening a surface of a mandrel having a chromium deposit thereon to form a toughened mandrel surface. The method also includes applying a layer of material to the roughened mandrel surface to form a roughened surface electroform; and separating the roughened surface electroform from the toughened mandrel surface.

Pursuant to another aspect of the present invention, there is provided a method for fabricating an electroform having a roughened surface. The fabrication method comprises roughening a surface of a stainless steel mandrel forming a roughened mandrel surface. The method also includes applying a layer of material to the roughened mandrel surface to form a roughened surface electroform; and separating the toughened surface electroform from the roughened mandrel surface.

Pursuant to another aspect of the present invention, there is provided an apparatus for creating a roughened electroform comprising: a reusable mandrel; means for roughening the surface of the reusable mandrel creating a toughened mandrel surface; means for applying a layer of material on the reusable mandrel to form a roughened surface electroform; and means for separating the surface roughened electroform from the roughened mandrel surface.

BRIEF DESCRIPTION OF THE DRAWINGS

Other features of the present invention will become apparent as the following description proceeds and upon reference to the drawings, in which.

DETAILED DESCRIPTION OF THE INVENTION

For a general understanding of an electroforming process in which the present invention may be incorporated, reference is made to U.S. Pat. No. 4,501,646 which describes the conventional electroforming process using a core mandrel and U.S. Pat. No. 4,902,386 which describes an electroforming mandrel and method of fabricating and using same. The contents of these patents are herein incorporated by reference.

Reference is now made to the drawings where the showings are for the purpose of illustrating a preferred embodiment of the invention and not for limiting same.

Figure 1:
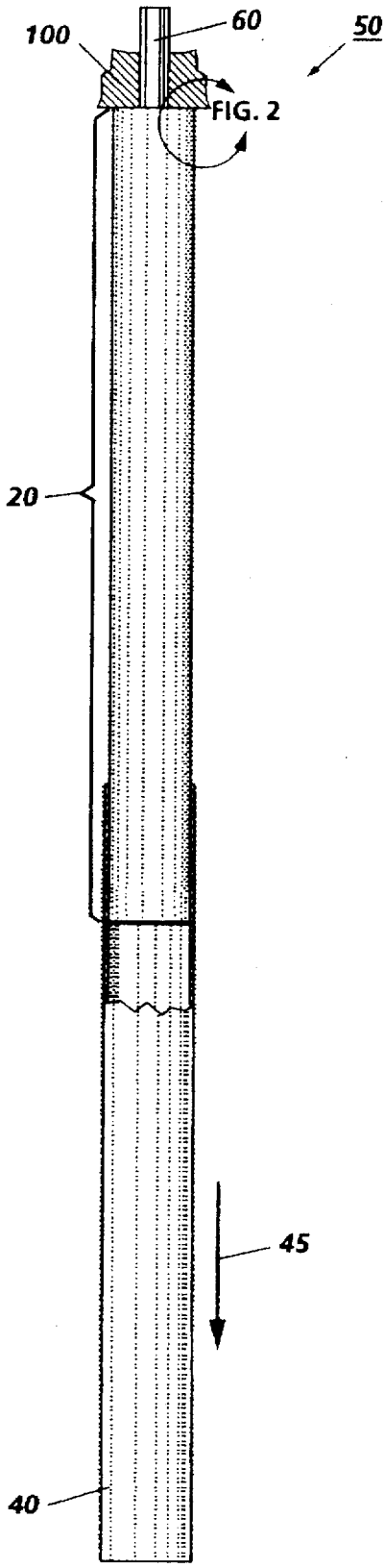
FIG. 1 shows a schematic view of a mandrel with a roughened mandrel surface and a partial break away view of the roughened electroform.

Reference is now made to FIG. 1, which shows a schematic view of a mandrel core with a roughened surface and a partial break away view of an electroform with a roughened surface. The mandrel 50 is comprised of a shaft 60 and a roughened surface 20. (The fixture 100 to which the shaft 60 is attached prevents electrolytes from forming between the shaft 60 and the top of the mandrel 50.) The surface of the mandrel 50 is roughened by sandblasting or a like toughening process. The surface of the mandrel 50, in the present invention, involves the use of a dual catalyzed non-self regulating crack free chromium deposit 70 (see FIG. 2) and sandblasting on the surface of the mandrel 50. The nickel plating produces a deposit which is rough at its inception and will continue to be sufficiently rough for this application even when substantial levels of stress reducers (which normally makes the deposit smoother) are added. This enables easy parting and economical production of parts.

With continued reference to FIG. 1, an electroform 40 is fabricated, about the roughened surface 20 of the mandrel 50, by applying current to the mandrel 50 through the shaft 60. The current facilitates plating of the mandrel 50, from a plating bath, creating an electroform 40 having the roughened surface of the mandrel 50. The present invention enables fabrication of a thin walled electroform 40 with a roughened surface that facilitates the distribution (i.e. transfer) of toner and sealing of the toner distribution module. (i.e. The electroform has a surface roughness of about 0.35 microns RMS which does not interfere with sealing. With microtoner less than or greater than 7 microns and the $R_a$ being below about 1.00 microns, adequate sealing occurs.) The thickness of the thin walled electroform ranges from about 10 microns to about 70 microns. A preferred embodiment of the surface roughness of the surface roughened electroform ranges from about 0.25 microns RMS to about 0.35 microns RMS. The surface roughness of the electroform ranges from about 0.15 microns RMS to about 1.25 microns RMS. (It is noted that the present invention is applicable to both male and female mandrels.) (The roughened surface of the electroform 40 provides toner distribution from the developer (not shown) to the photoreceptor (not shown) as the electroform 40 rotates between the developer and the photoreceptor.)

Sandblasting a mandrel to create an electroform with a roughened surface has previously required the mandrel to be disposable. The affinity between the roughened surface of the mandrel and the roughened surface of the electroform in contact with the mandrel required dissolving of the mandrel to separate the electroform from the mandrel. This process is both expensive and time consuming because each fabrication of an electroform requires a new mandrel. In the present invention, the mandrel is permanent and reusable reducing the expense and time of creating a new surface roughened mandrel for each surface roughened electroform created. Furthermore, the chromium deposit maintains the surface mandrel roughness throughout the life of the mandrel.

Creating an electroform with a roughened surface using an electro-depositing bath requires thicker deposits of the material being plated (e.g. about 60 microns to about 125 microns). Hence, sandblasting the surface of the mandrel, as in the present invention, allows the use of thinner films as electroforms. The surface roughness of the thinner films made by the roughened surfaces of the mandrel range from about 0.15 microns RMS to about 1.25 microns RMS.

Electroforming sleeves, belts, or tubes (e.g. nickel, copper and brass) with diameters of less than about 40 mm requires capitalization on the process of hysteresis and the use of a system which produces an electroform which is at least nearly zero in internal tensile stress. Stress reducers are required to maintain the desired internal stress. The stress reducers can also cause the electroform deposit to be smoother. If a rough mandrel is used to get the desired roughness, it is required that even more stress reducers be used so that the electroform can be separated from the mandrel. If more stress reducers are required, the purpose of roughening the mandrel is defeated unless hysteresis is used.

Small diameter (i.e. about 25 mm) thin walled nickel sleeves (of about 0.04 mm) with surface roughness ($R_a$) of about 0.33 microns have been found to be useful as toner donor roll coverings. Prior to the present invention, to achieve small diameter, surface roughened sleeves (i.e. electroforms), the sleeves were made on a non-permanent mandrel. Each sleeve required the manufacture of a new mandrel which could only be used once making this an expensive process.

The present invention involves sandblasting a mandrel which has been chromium plated with a dual catalyzed non-self regulating crack free chromium. The chromium plating produces a deposit which is rough at its inception and will continue to be sufficiently rough throughout the life of the mandrel even when substantial levels of stress reducers are added. This enables easy parting and economical production of parts. The electroform 40 is removed from the mandrel by sliding the electroform, in the direction of arrow 45, after parting between the mandrel and the electroform 40 has occurred. Another embodiment of the present invention involves sandblasting a stainless steel mandrel to produce a roughened electroform.

Figure 2:
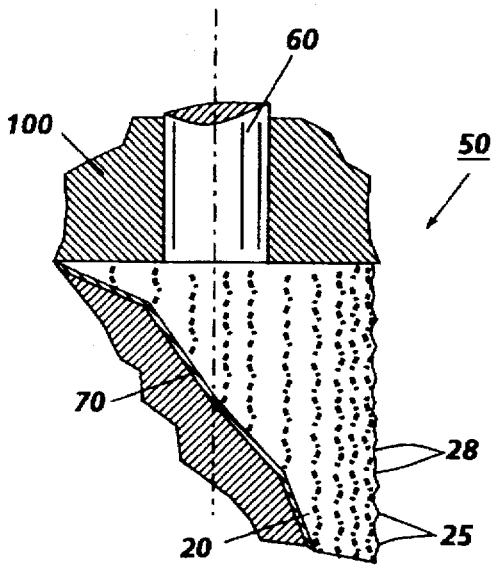
FIG. 2 shows an enlarged view of the roughened surface of the mandrel.

Reference is now made to FIG. 2, which shows a partial enlargement of the roughened surface indicated in FIG. 1. Sandblasting the mandrel having a chromium deposit 70 on the surface creates protuberances 25 (i.e. peaks) and pits 28 (i.e. valleys) in the surface of the mandrel forming the roughened surface 20.

In recapitulation, the present invention discloses the use of a reusable mandrel having a roughened mandrel surface for creating an electroform with a roughened surface. The surface of the mandrel has a chromium deposit thereon prior to roughening the mandrel surface. The chromium deposit is a dual catalyzed non-self regulating crack free chromium and a surface preparation to maintain the roughened surface of the mandrel. An alternate embodiment involves the use of stainless steel mandrel without a chromium deposit on the surface. The mandrel is plated with a material (e.g. metal) in a thin layer to form a thin walled electroform. The method and apparatus, of the present invention, enables the creation of a thin walled electroform, having a small diameter which previously could not be attained with a permanent (i.e. reusable) mandrel. The rough surface of the electroform facilitates the distribution of toner and the sealing of the toner distribution module.

It is therefore apparent, that there has been provided in accordance with the present invention, an electroform with a roughened surface that fully satisfies the aim and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

It is claimed:

1. A method for fabricating an electroform having a roughened surface, comprising:

roughening a surface of a mandrel having a chromium deposit thereon by sandblasting the surface of the mandrel creating protuberances and pits thereon;

plating the surface of the mandrel with a layer of material having a thickness ranging from about 10 microns to about 70 microns forming an initial roughened surface electroform to facilitate distribution of toner particles between developing and an imaging surface; and separating said roughened surface electroform from said roughened mandrel surface.

2. A method as recited in claim 1, wherein the separating step comprises:

parting said roughened surface electroform from said roughened mandrel surface, maintaining a reusable mandrel having a roughened surface; and removing the electroform, along a longitudinal axis of said reusable mandrel having the roughened surface, to separate said roughened surface electroform therefrom.

3. A method for fabricating an electroform having a roughened surface, comprising:

roughening a surface of a mandrel having a chromium deposit thereon by sandblasting the surface of the mandrel creating protuberances and pits thereon;

plating the surface of the mandrel with a layer of material having a thickness ranging from about 10 microns to about 70 microns forming an initial roughened surface electroform to facilitate distribution of toner particles between developing and an imaging surface;

separating said roughened surface electroform from said roughened mandrel surface by parting said roughened surface electroform from said roughened mandrel surface, maintaining a reusable mandrel having a roughened surface and removing the electroform, along a longitudinal axis of said reusable mandrel having the roughened surface, to separate said roughened surface electroform therefrom; and replacing said reusable mandrel with a layer of material having a thickness ranging from about 10 microns to about 70 microns forming another roughened surface electroform.

4. An apparatus for creating a roughened electroform comprising:

a reusable mandrel having a surface;

a sandblasting device for creating protuberances and pits on the surface of said reusable mandrel for roughening the surface coated with a chromium deposit on said reusable mandrel creating a roughened mandrel surface enabling toner distribution, said chromium deposit comprising a dual catalyzed non-self regulating crack free chromium to maintain the roughened mandrel surface;

means for applying a layer of material comprising a plating bath for applying material to the roughened reusable mandrel surface creating said roughened surface electroform to facilitate distribution of toner particles between developing and an image surface, the layer of material being applied to said roughened mandrel surface comprises a thickness range of about 10 microns to about 70 microns:, and means for separating said surface roughened electroform from said roughened mandrel surface.

5. An apparatus as recited in claim 4, wherein said roughened surface electroform has a diameter of about 25 mm.

6. An apparatus as recited in claim 5, wherein the roughened surface electroform comprises a roughness ranging from about 0.15 microns to about 1.25 microns.

7. An apparatus as recited in claim 6, wherein said separating means comprises means for parting said roughened surface electroform from said roughened mandrel surface enabling slidable removal of said roughened surface electroform from the surface of said reusable mandrel.

* * * * *